US006176165B1

(12) United States Patent
Dotey

(10) Patent No.: US 6,176,165 B1
(45) Date of Patent: Jan. 23, 2001

(54) DEVICE FOR FEEDING PIECES OF STRIP MATERIAL TO A PICKING STATION

(75) Inventor: Robert L. Dotey, Wilmington, DE (US)

(73) Assignee: Herblitz Modular Systems S.r.l., Turin (IT)

( * ) Notice: Under 35 U.S.C. 154(b), the term of this patent shall be extended for 0 days.

(21) Appl. No.: 09/414,775

(22) Filed: Oct. 8, 1999

(51) Int. Cl.[7] ..... B26D 7/32

(52) U.S. Cl. ..... 83/98; 83/149; 83/230; 83/268; 83/639.1

(58) Field of Search ..... 83/98, 99, 149, 83/78, 225, 226, 227, 228, 229, 230, 235, 268, 269, 270, 639.1

(56) References Cited

U.S. PATENT DOCUMENTS 1,880,935 * 10/1932 Elliot et al. ..... 83/98 X
2,219,682 * 10/1940 Doble ..... 83/98 X
2,479,950 * 8/1949 MacPheat ..... 83/228 X
3,667,331 * 6/1972 Regec et al. ..... 83/98
3,732,763 * 5/1973 Smuda ..... 83/98
4,405,126 * 9/1983 Frye et al. ..... 83/98 X
4,542,842 * 9/1985 Reba ..... 83/98 X
4,580,473 * 4/1986 Seiden et al. ..... 83/98 X
5,448,933 * 9/1995 Grabbee ..... 83/98 X
5,937,717 * 8/1999 Iino ..... 83/227 X

* cited by examiner

*Primary Examiner*—Rinaldi I. Rada
*Assistant Examiner*—Charles Goodman
(74) *Attorney, Agent, or Firm*—Sughrue, Mion, Zinn, Macpeak & Seas, PLLC

(57) ABSTRACT

Device (1) for feeding pieces of strip material (P) to a picking station (6), including a strip feeding unit (3), a cutting unit (4), and a conveying group (5) of the pieces of strip (P) comprising a duct (13*b*) extending between the cutting unit (4) and the picking station (6), a system for generating a pneumatic conveying flow (21, 22) in the duct (13*b*), and a pneumatic braking device (32, 33, 34) of the pieces of strip (P) during their movement produced by the pneumatic conveying flow.

12 Claims, 5 Drawing Sheets

DEVICE FOR FEEDING PIECES OF STRIP MATERIAL TO A PICKING STATION

BACKGROUND OF THE INVENTION

This invention relates to a device for feeding pieces of strip or web material to a picking station, including strip feeding means, a cutting unit fed by said feeding means for cutting the strip crosswise into pieces of a preestablished length, conveying means for transferring said pieces from the cutting unit to said picking station, and synchronized actuating means of the feeding means, of the cutting unit and of the conveying means.

The invention relates in particular, though not exclusively, to a feeding device of the above type wherein the pieces of material in a strip consist of pieces of predetermined length of a metallic conducting strap, provided with a longitudinal series of equidistant holes, intended to be transferred via a robotized gripper to an electrical equipment assembling station.

SUMMARY OF THE INVENTION

The object of this invention is that of producing a feeding device of the type defined above having qualities of great simplicity, reliability and precision, with particular reference to the conveying of the pieces of strip from the cutting unit to the picking station.

According to the invention, this object is attained due to the fact that, in a feeding device of the type defined at the beginning, the above-mentioned conveying means include a duct extending between the cutting unit and the picking station, means for generating in said duct a pneumatic flow for the conveying of each piece of strip, and a device for pneumatic braking of the piece of strip during its movement produced by said pneumatic conveying flow.

Advantageously, the pneumatic braking device includes discharging means for sending at least one jet of air under pressure against the piece of strip, normally at an angle with respect to the direction in which it is conveyed inside said duct.

According to another aspect of the invention, means are provided for exposing the above-mentioned duct to the outside, at least in the vicinity of the picking station, at the end of the movement of the piece of strip produced by the pneumatic flow.

BRIEF DESCRIPTION OF THE DRAWINGS

The invention will now be described in detail with reference to the accompanying drawings, provided purely by way of a non-restricting example, and in which.

DETAILED DESCRIPTION OF THE INVENTION

Figure 2:
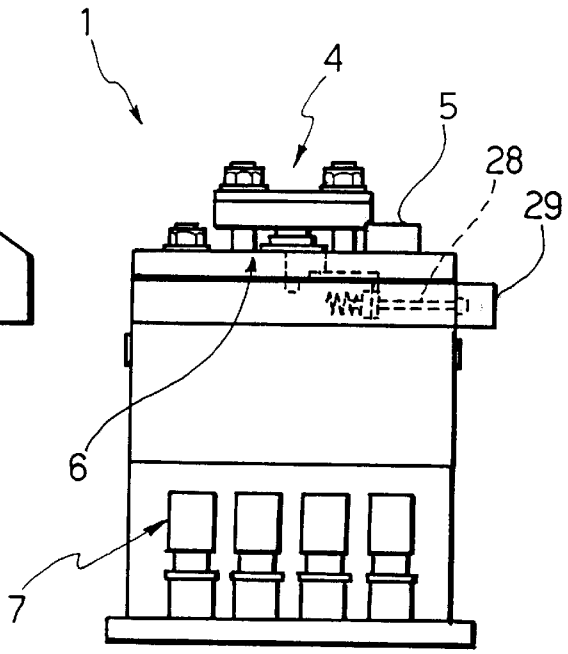
FIG. 2 is a frontal elevation view according to the arrow II in FIG. 1.
Figure 1:
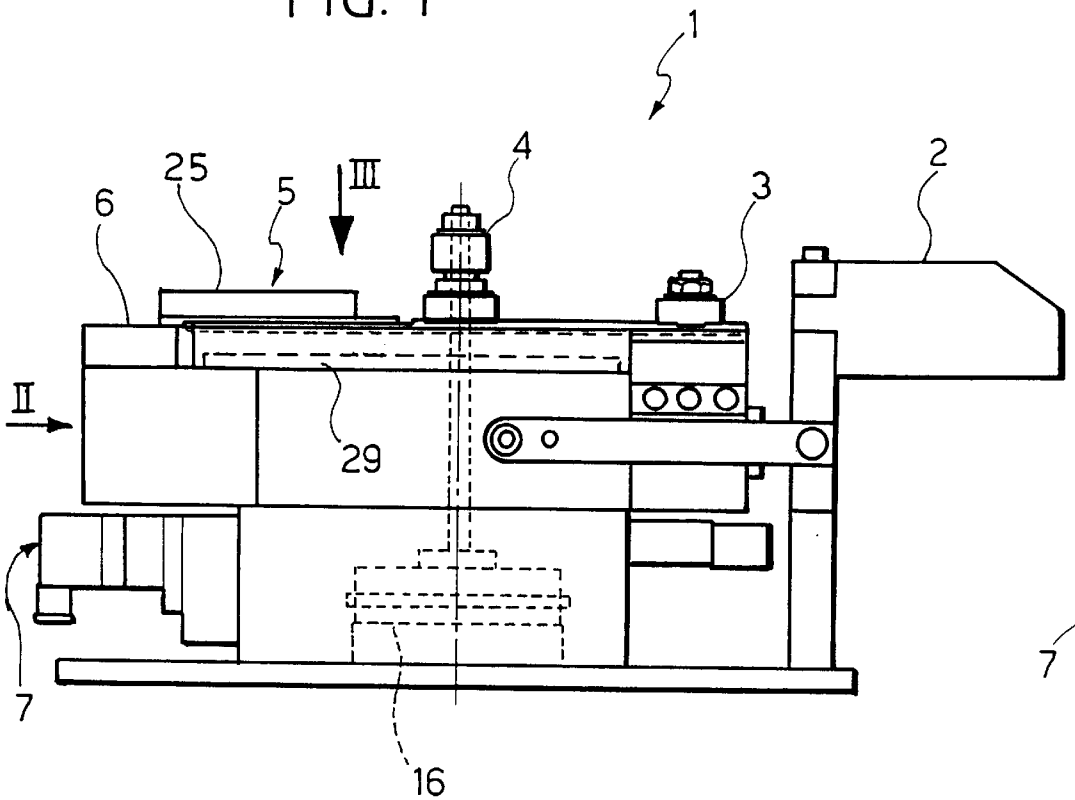
FIG. 1 is a general schematic view in lateral elevation of a feeding device according to the invention.

With reference initially to FIGS. 1 and 2, a feeding device according to this invention is generically indicated as a whole with the numeral 1. The feeding device 1 is intended particularly for use with strip or web material, and more particularly with conducting metal straps P (FIGS. 4, 5 and 8) wound up on a reel and provided with a longitudinal series of equidistant through holes or windows A.

In short, the device 1 comprises a unit 2 for straightening the strip on the reel, a pneumatically driven feeder 3 for feeding longitudinally in steps the conducting metal strap P, a cutting unit 4, also pneumatically driven, fed by the feeder 3 and adapted for cutting crosswise the metal strap P into pieces of preestablished length, and a pneumatic group 5 conveying the piece of meal strap P cut each time by the cutting unit 4 to a picking station 6.

The feeding device 1 also comprises a solenoid valve assembly, indicated generically with the numeral 7, operatively connected to an electronic control unit for handling the various pneumatic actuators of the feeder 3, of the cutting unit and of the conveying group 5 in a way that is synchronized according to a preestablished operating cycle, with the arrangements described below.

The straightening device 2, the feeder 3 and the cutting unit 4 are made from generally conventional devices and, for the sake of brevity, will not therefore be described in detail. In particular, the feeder 3 is advantageously of the type described and illustrated in the European patents EP-B-655405 and EP-B-655406, including in short a stationary gripper and a mobile gripper, each comprising a fixed jaw and a mobile jaw, and a pneumatic actuator for commanding the linear alternating movement forward and backward of the mobile gripper with respect to the stationary gripper, and the opening and closing movements of the mobile jaws of the grippers in sync with the alternating movement of the mobile gripper. The feeder 3 also comprises an adjustable abutment member, interacting with the mobile gripper to limit its forward movement and, as a result, to regulate the step, that is the length of the metal strap P fed each time to the cutting unit 4.

Figure 4:
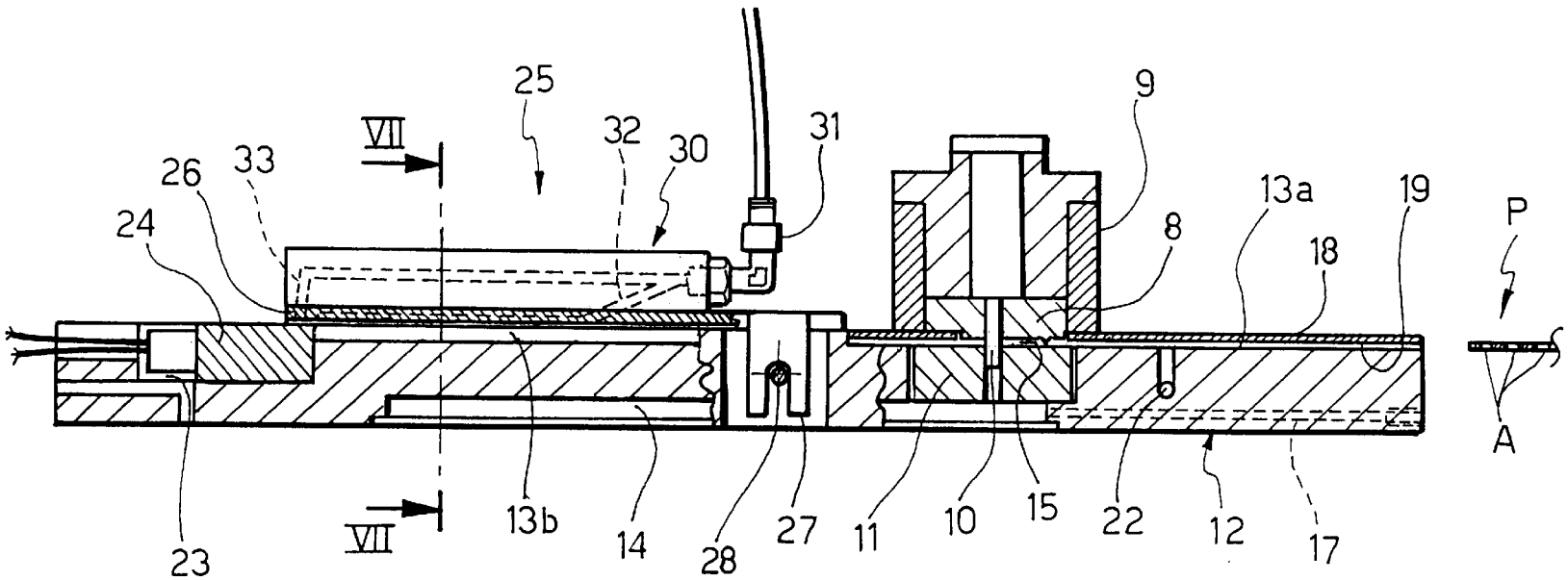
FIG. 4 is a view in longitudinal section on an enlarged scale according to the line IV—IV in FIG. 3.
Figure 5:
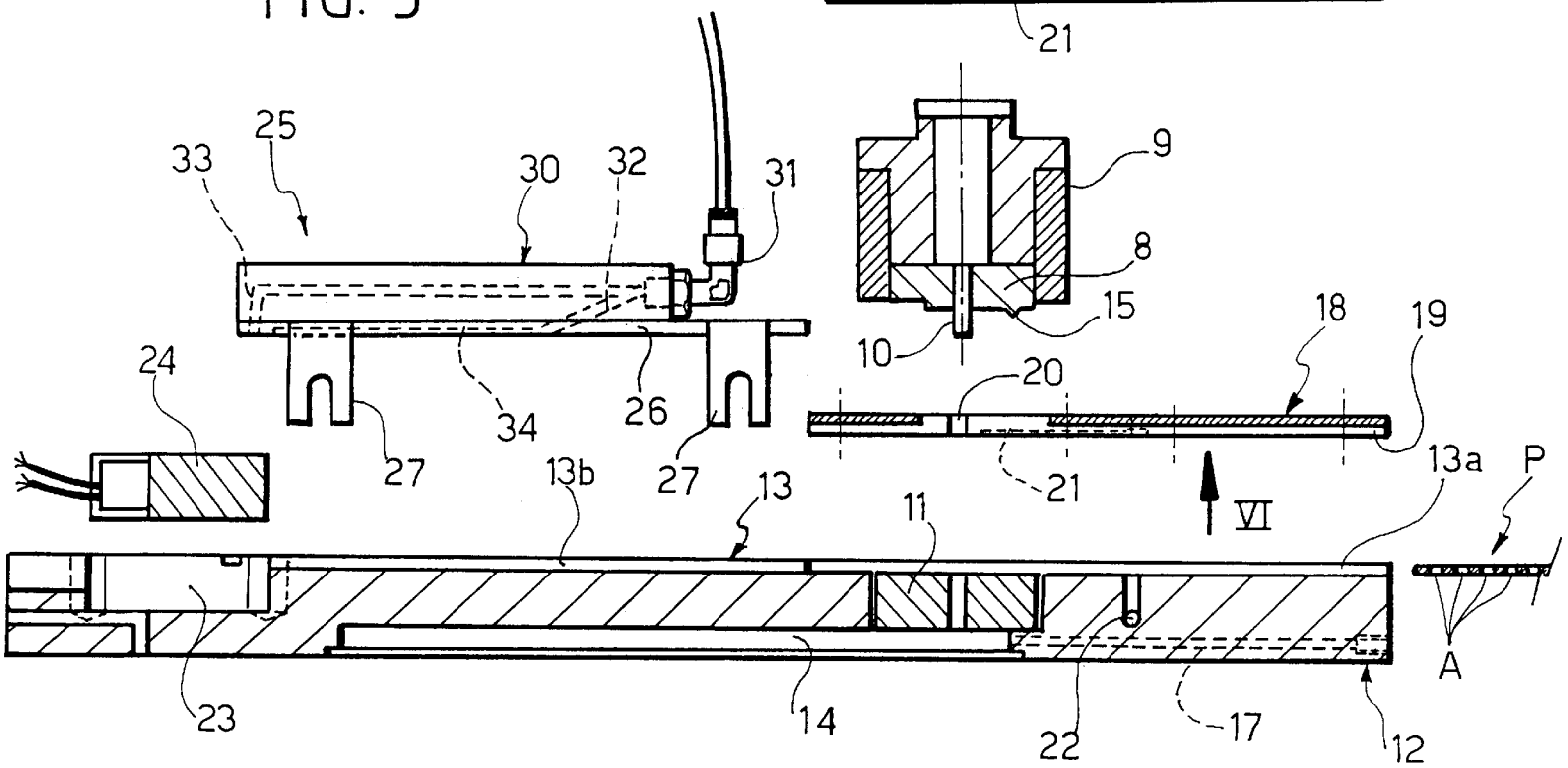
FIG. 5 is an exploded view FIG. 4.

As is illustrated in detail in FIGS. 4 and 5, the essential components of the cutting unit 4 include a pressing member 8 vertically movable with respect to a support body 9 between a raised position and a lowered position, a punch 10 vertically movable with respect to the pressing member 8 between an inoperative raised position and a lowered cutting position, and a bottom matrix 11. The support 9 and the matrix 11 are borne by a horizontal board 12 which has on its upper face a longitudinal channel 13 and at the bottom a longitudinal groove 14 which extends from the matrix 11 of the cutting unit 4 for the removal of the shavings of the metal strap P produced each time by the punch 10.

The pressing member 8 is provided at the feeder 3 end with a projection 15 extending downwards for engaging the apertures A in the metal strap P, in order to guarantee the required precision of alignment during the cutting operation.

Figure 6:
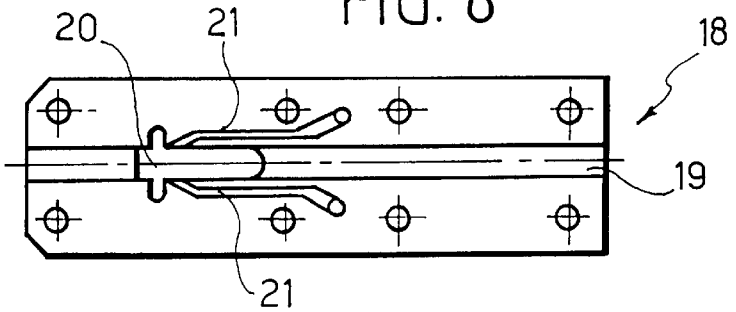
FIG. 6 is a plan view from below of the detail indicated by the arrow VI in FIG. 5.

The pneumatic actuating group of the cutting unit 4 is indicated schematically with the numeral 16 in FIG. 1. In addition, this actuating group 16 is operatively associated with a pneumatic system for removal of the shavings from the lower channel 14, via a compressed air feeding passage 17 provided in the board 12, and with the conveying group 5. To this end, the portion of the upper channel 13 indicated with 13*a*, between the outlet of the feeder 3 and the cutting unit 4, is partially closed at the top by a plate 18, illustrated in detail in FIG. 6, the lower face of which has a longitudinal groove 19 facing the channel portion 13*a* and in which an aperture 20 has been made for the passage of the pressing member 8 and the punch 10. Two lateral channels 21 come together at the aperture 20, and to these compressed air is supplied by the pneumatic group 16 through passages 22 in the board 12. This compressed air is then conveyed into the portion of the channel 13 indicated with 13*b*, between the cutting unit 4 and the picking station 6, i.e. extending through the pneumatic conveying group 5.

The picking station 6 in practice comprises the end extremity of the channel portion 13*b*, which faces a seat 23 in the board 12 into which a striker plate 24 has been inserted, suitable for detecting the presence against it of a piece of metal strap P and for supplying a corresponding electric signal enabling the picking up of that piece, for example by a robotized gripper.

The peculiar feature of this invention is in actual fact the conveying device 5 which, in addition to the channel portion 13*b* into which the compressed air coming from the passages 21 and 22 is fed, also includes a receptacle indicated as a whole with the numeral 25. This receptacle comprises a base board 26 which is operatively connected by way of brackets 27 to a pair of linear pneumatic actuators 28 activated through a common collector 29 borne on one side of the board 12 for the feeding of the compressed air. The base board 26 supports a distributor body 30 which, by way of a coupling 31, is connected to a pneumatic feeding group, and more advantageously to the activating group of the actuators 28.

The coupling 31, with which a one-way valve is advantageously associated, communicates with the base of the distributor body 30 through an initial nozzle passage 32 and a final nozzle passage 33, both leading to a lower longitudinal groove 34 parallel to the channel portion 13*b*. The initial passage 32 is conveniently inclined with respect to the lower groove 34 by an angle of between 20° and 40°, preferably of 30°, whereas the end passage 33 is conveniently inclined with respect to the lower groove 34 by an angle of between 50° and 80°, preferably of 60°.

Figure 3:
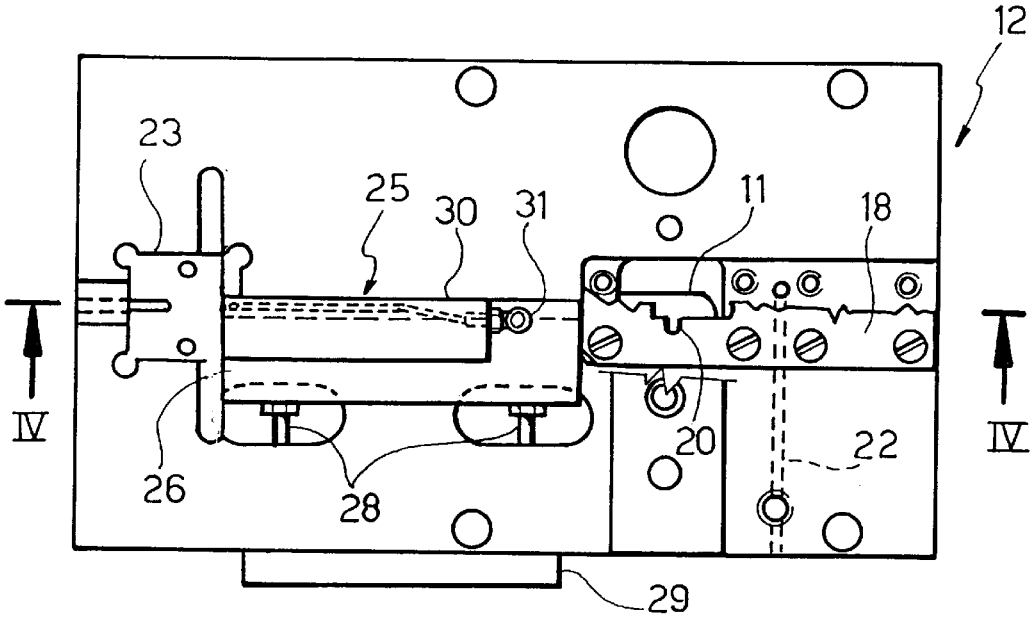
FIG. 3 is a partial, simplified and partly sectioned plan view from above on an enlarged scale according to the arrow III in FIG. 1 in a first operating position of the feeding device.
Figure 8:
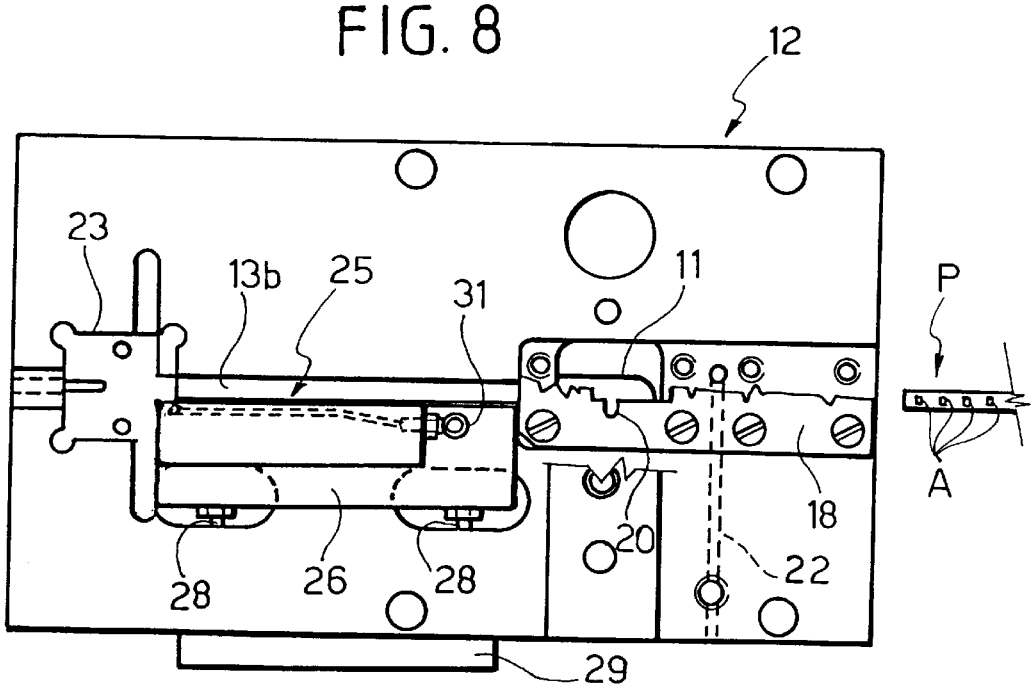
FIG. 8 is a similar view to that of FIG. 3 in a second operating condition of the feeding device.
Figure 9:
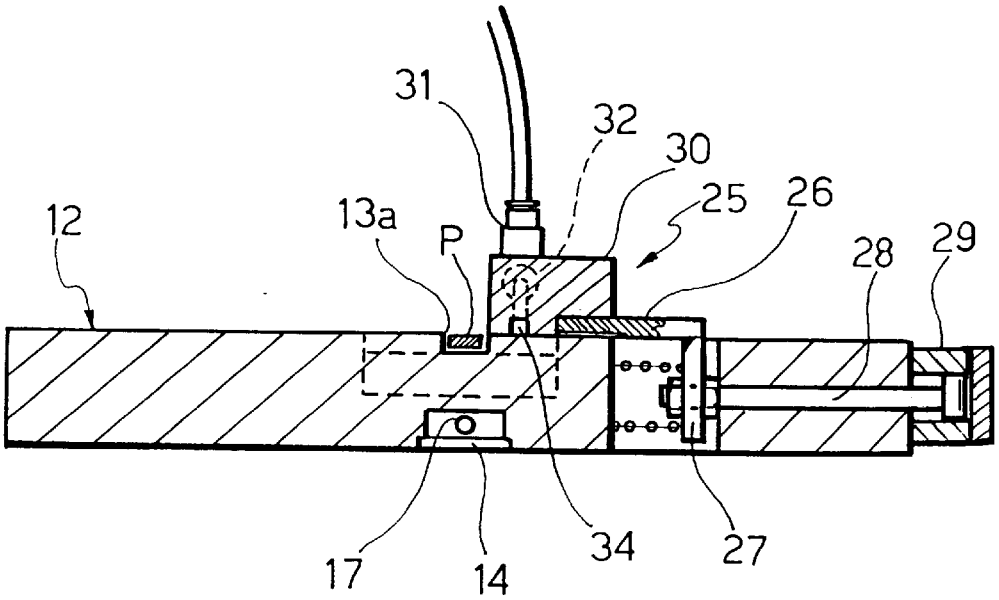
FIG. 9 is a similar view to that of FIG. 7 in the operating condition of FIG. 8.
Figure 7:
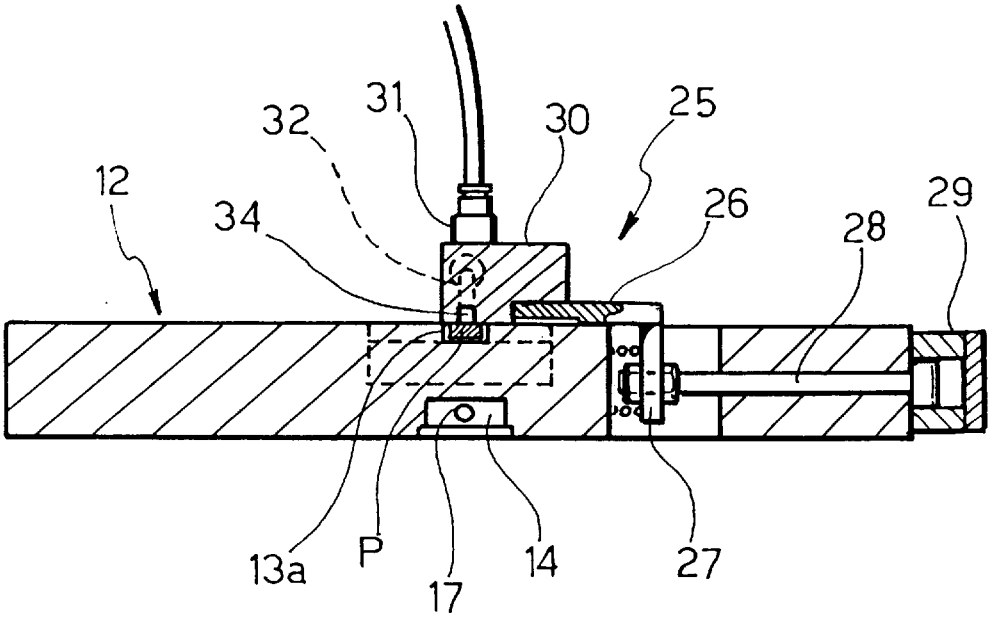
FIG. 7 is a view in transversal section according to the line VII—VII in FIG. 4.

Through the two pneumatic actuators 28, the receptacle 25 consisting of the base plate 26 and the distributor body 30 is movable between the advanced position depicted in FIGS. 3 and 7 and the withdrawn position of FIGS. 8 and 9. In the advanced position of FIGS. 3 and 7, the distributor body 30 closes from the top the channel portion 13*b*, so that the latter has the configuration of a substantially pneumatically tight duct, with the lower groove 34 and the passages 32 and 33 coming into communication at the back of this duct. In the withdrawn position of FIGS. 8 and 9, the distributor body 30 is displaced laterally with respect to the groove portion 13*b*, so that the latter is open at the top, permitting access from above to the piece of meal strap P transferred each time to the station 6, and pickingup of the same.

The base board 26 of the receptacle 25 is conveniently slightly inclined towards the picking station 6, for example by one degree or less so that the groove portion 13*b*, when closed by the base board 26, is in practice tapered towards the picking station.

The operation of the feeding device 1 described above is as follows.

Through the feeder 3 the metal strap P is fed in steps of predetermined length to the cutting unit 4, which cuts it transversally into pieces of a desired length. The piece cut on each occasion is then transferred against the gauge block 24 of the picking station 6 by means of the pneumatic conveying flow generated through the passages 21 and 22 and input into the duct comprising the groove portion 13*b* closed at the top by the distributor body 30, in the advanced position of the receptacle 25 already described. The movement of the piece of metal strap P along the duct is braked due to the flow of compressed air delivered through the initial passage 32 and the final passage 33 of the distributor body 30. This braking action exerts a controlled thrusting of the piece of metal strap P against the back of the groove portion 13*b* which, as effectively as surprisingly, permits this piece of metal strap P to stop exactly resting against the gauge block 24, without any risk of bouncing and consequently of undesired returns in the direction of the cutting unit 4.

At the end of the phase of pneumatic conveying of the piece of meal strap P, the receptacle 25 is moved into the withdrawn position described previously, and following the enable signal produced by the gauge block 24, the piece of meal strap P may be extracted from the feeding device 1, which then proceeds to the next cycle of feeding/cutting/transferring a new piece of meal strap P.

Naturally the construction details and the embodiments may be altered considerably with respect to those described and illustrated, without departing from the scope of the present invention, as defined in the claims that follow.

What is claimed is:

1. Device (1) for feeding pieces of strip material (P) to a picking station (6), comprising:

strip feeding means (3);

a cutting unit (4) fed by said feeding means (3) for cutting the strip (P) crosswise into pieces of preestablished length;

conveying means (5) for transferring said pieces of strip (P) from the cutting unit (4) to said picking station (6); and synchronized actuating means for actuating the feeding means (3), the cutting unit (4) and the conveying means (5), wherein said conveying means (5) include a duct (13*b*) extending between the cutting unit (4) and the picking station (6), means for generating in said duct (13*b*) a pneumatic flow (21, 22) for the conveying of each piece of strip (P), and a device (32, 33, 34) for pneumatic braking of the piece of strip (P) during movement of the piece of strip produced by said pneumatic conveying flow.

2. Feeding device according to claim 1, wherein said pneumatic braking device includes discharging means (32, 33) for sending at least one jet of air under pressure against the piece of strip (P).

3. Feeding device according to claim 2, wherein said jet of air under pressure is sent at an angle with respect to said duct (13*b*).

4. Feeding device according to claim 3, wherein said discharging means includes a nozzle (32) facing a back wall of said duct (13*b*) at a starting extremity thereof and inclined with respect to said duct (13*b*) by a predetermined angle of between 20° and 40°, and a longitudinal passage (34) open towards said back wall of the duct (13*b*) and communicating with said nozzle (32).

5. Feeding device according to claim 4, comprising a further nozzle (33) facing a back wall of said duct (13*b*) and inclined with respect to said duct (13*b*) by an incline angle of between 50° and 80°.

6. Feeding device according to claim 5, wherein said incline angle is 60°.

7. Feeding device according to claim 4, wherein said predetermined angle is 30°.

8. Feeding device according to claim 1, further comprising means (25, 28) for exposing said duct (13*b*) to an outside, at least in a vicinity of said picking station (6), at an end of movement of the piece of strip (P) produced by said pneumatic flow.

9. Feeding device according to claim 8, wherein said exposing means includes motorized actuating means for moving a wall (30) of said duct (13*b*) between a closed position and an open position of the duct (13*b*) in synchronism with said means for generating said pneumatic conveying flow (21, 22).

10. Feeding device according to claim 9, wherein said actuator means (28) are pneumatic and also feed said pneumatic braking means (32, 33, 34).

11. Feeding device according to claim 1, wherein said actuating means (16) of the cutting unit (4) are pneumatic and also feed said means for generating in said duct (13) the flow (21, 22) conveying the pieces of strip (P) and also pneumatic means (14, 17) for removing shavings.

12. Feeding device according to claim 1, wherein said duct (13*b*) is tapered towards said picking station (6).

* * * * *